US009725263B2

(12) United States Patent
Takai et al.

(10) Patent No.: US 9,725,263 B2
(45) Date of Patent: Aug. 8, 2017

(54) SHEET FEEDING CARTRIDGE AND IMAGE FORMING APPARATUS

(71) Applicant: KYOCERA Document Solutions Inc., Osaka (JP)

(72) Inventors: Hiroaki Takai, Osaka (JP); Yoshio Sugishima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/075,584

(22) Filed: Mar. 21, 2016

(65) Prior Publication Data

US 2016/0280482 A1 Sep. 29, 2016

(30) Foreign Application Priority Data

Mar. 27, 2015 (JP) ..... 2015-066720

(51) Int. Cl.
*B65H 1/04* (2006.01)
*B65H 1/26* (2006.01)
*G03G 15/00* (2006.01)

(52) U.S. Cl.
CPC ..... *B65H 1/266* (2013.01); *G03G 15/6502* (2013.01); *B65H 2405/114* (2013.01); *B65H 2405/12* (2013.01); *B65H 2405/13* (2013.01); *B65H 2511/12* (2013.01); *B65H 2511/22* (2013.01)

(58) Field of Classification Search
CPC .. B65H 1/04; B65H 2511/18; B65H 2405/00; B65H 2405/112; B65H 2405/1122; B65H 2405/1142; B65H 2405/11425; B65H 2405/1144
USPC ..... 271/171
See application file for complete search history.

(56) References Cited

U.S. PATENT DOCUMENTS 6,169,561 B1 * 1/2001 Fisher, Sr. ..... B41J 11/0025 271/171
6,669,188 B1 * 12/2003 Marasco ..... B65H 1/04 271/145
7,533,880 B2 * 5/2009 Kawanishi ..... B65H 1/266 271/171
7,946,575 B2 * 5/2011 Kim ..... B41J 13/103 271/171

(Continued)

FOREIGN PATENT DOCUMENTS

JP H06-321364 A 11/1994
JP H07-309456 A 11/1995

*Primary Examiner* — Patrick Cicchino
(74) *Attorney, Agent, or Firm* — Studebaker & Brackett PC

(57) ABSTRACT

A sheet feeding cartridge storing a sheet conveyed orthogonally to a width direction includes a main body, a pair of side cursors and a restricting member. The main body has a bottom part including a sheet placement face and allows sheets of different sizes to be placed. The side cursors mutually slide in approaching and separating directions and restrict a position in the width direction. The restricting member comes into contact with a side edge in the width direction at a position separated from one of the side cursors to an upstream side in a conveyance direction and restricts the position in the width direction. The restricting member is attachably/detachably provided in the main body at each of plural positions along the width direction and restricts the side edge of each of the sheets of different sizes in the width direction.

7 Claims, 9 Drawing Sheets

(56) References Cited

U.S. PATENT DOCUMENTS

| | | | | |
|---|---|---|---|---|
| 8,038,359 | B2 * | 10/2011 | Lee | B41J 13/103<br>271/145 |
| 2007/0069450 | A1 * | 3/2007 | Kawanishi | B65H 1/266<br>271/162 |
| 2008/0315498 | A1 * | 12/2008 | Ikeda | B65H 1/08<br>271/18 |
| 2015/0097330 | A1 * | 4/2015 | Sato | B65H 1/14<br>271/160 |

* cited by examiner

SHEET FEEDING CARTRIDGE AND IMAGE FORMING APPARATUS

This application is based on and claims the benefit of priority from Japanese Patent application No. 2015-066720 filed on Mar. 27, 2015, the entire contents of which are incorporated herein by reference.

BACKGROUND

The present disclosure relates to a sheet feeding cartridge storing a sheet onto which an image is formed and the image forming apparatus including this sheet feeding cartridge.

In an image forming apparatus, such as a multifunction peripheral or a printer, a sheet feeding cartridge storing a sheet onto which an image is formed is attachably/detachably provided. In the sheet feeding cartridge, a position in a width direction of the sheet is restricted by a pair of cursors slidably provided so that a center in the width direction of the sheet is coincident with a center in a width direction of the image to be formed.

The pair of cursors are generally formed to correspond to a sheet size with a high frequency of use (for example, A4 size) and thus if a sheet of a larger size (for example, B4 size or more) than this size is stored, there may be a case where restriction of the position in the width direction by the pair of cursors is not carried out at a rear end part of the sheet (at an end part on a downstream side in a conveyance direction). In a case where the restriction of the position at the rear end part of the sheet is not carried out, in the image forming apparatus in which the sheet feeding cartridge is attached along the width direction of the sheet, if an inertial force in the width direction is applied to the sheet at the time of attaching the sheet feeding cartridge storing the sheet of the large size, there is an possibility that skew of the rear end part of the sheet occurs. If such skew of the sheet occurs, there arises a problem that a sheet feeding failure occurs or an image failure that no image is formed at a predetermined position on the sheet occurs.

Accordingly, in order to prevent the skewness of the sheet of the large size, there is a sheet feeding cartridge in which, at an end cursor restricting the position in the conveyance direction of the sheet, a pair of side cursors for rear end part restricting the width direction of the rear end part of the sheet are provided independently of the pair of cursors. Moreover, there is a sheet feeding cartridge in which a rib restricting the position of the rear end part of the sheet of large size is formed.

However, in the sheet feeding cartridge as mentioned above, because the side cursors for rear end part are exclusively provided, there is a problem that the sheet feeding cartridge is enlarged or the mechanism is complicated. In addition, in the sheet feeding cartridge as mentioned above, because the rib for position restriction is merely compatible with a sheet of a specific size, there is a problem that it is impossible to cope with diversification of the sheet sizes.

SUMMARY

In accordance with the present disclosure, a sheet feeding cartridge configured to store a sheet to be conveyed in a direction orthogonal to a width direction includes a main body, a pair of side cursors and a restricting member. The main body has a bottom part including a sheet placement face and allows sheets of different sizes to be placed. The pair of side cursors are configured to mutually slide in approaching and separating directions, and then, to restrict a position in the width direction. The restricting member is configured to come into contact with a side edge in the width direction at a position separated from one of the pair of side cursors to an upstream side in a conveyance direction, and then, to restrict the position in the width direction. The restricting member is attachably/detachably provided in the main body at each of a plurality of positions along the width direction and is capable of restricting the side edge of each of the sheets of different sizes in the width direction.

In accordance with the present disclosure, an image forming apparatus includes the above-mentioned sheet feeding cartridge, an image forming part and a housing. The image forming part is configured to form an image on the sheet conveyed in an orthogonal direction to the width direction of the sheet from the sheet feeding cartridge. In the housing, the sheet feeding cartridge is attachably/detachably installed and the image forming part is built.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the drawings, an image forming apparatus according to an embodiment of the present disclosure will be described.

Figure 1:
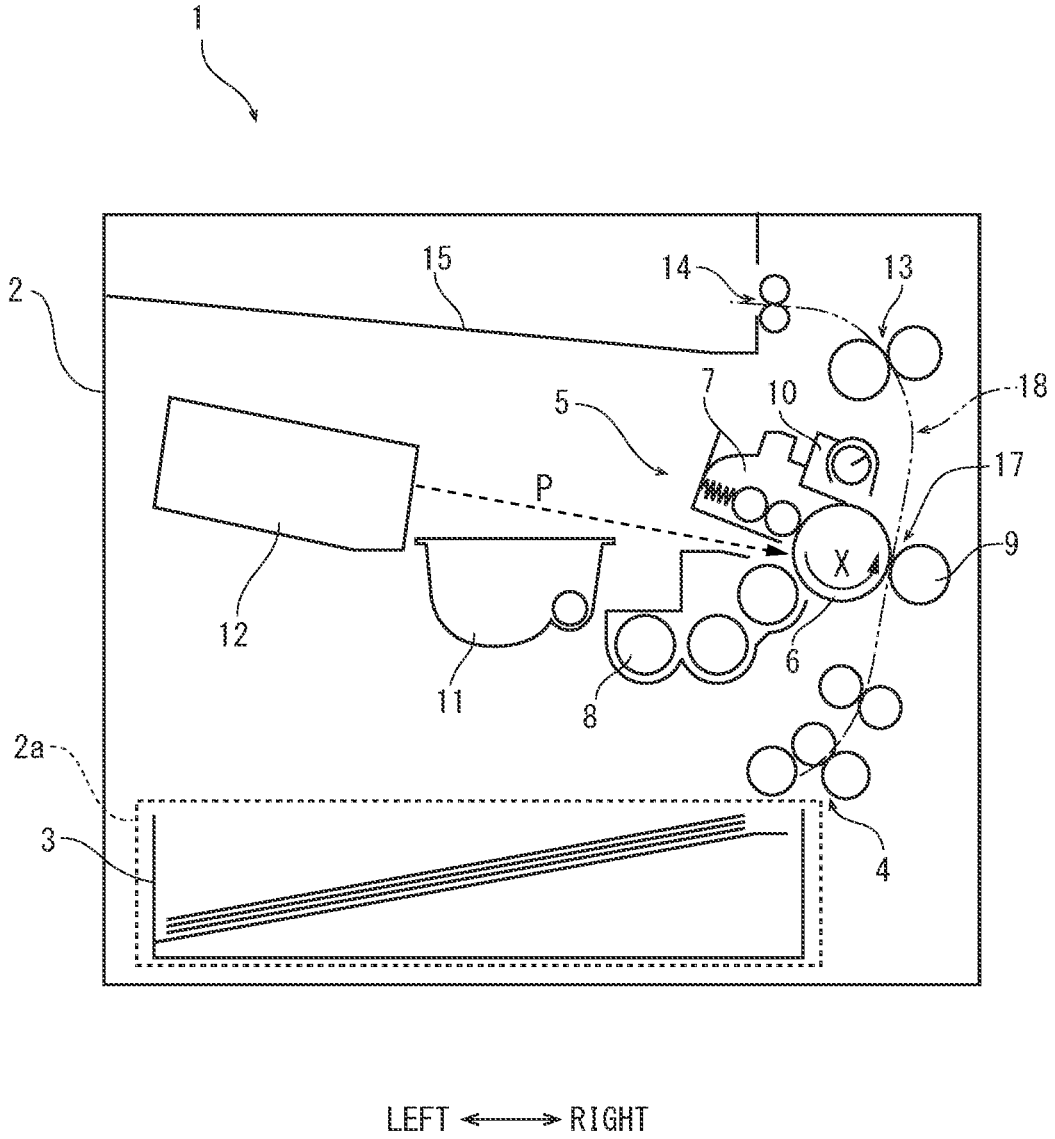
FIG. 1 is a sectional view schematically showing an internal structure of a printer according to an embodiment of the present disclosure.

First, with reference to FIG. 1, entire structure of a printer 1 of the image forming apparatus will be described. FIG. 1 is a sectional view schematically showing the printer in accordance with the embodiment of the present disclosure. Incidentally, hereinafter, it will be described so that the front side of the printer 1 is positioned at the near side of FIG. 1 and that left and right directions is defined as seen from the front side of the printer 1.

The printer 1 includes a roughly rectangular parallelepiped housing 2 having a hollow part. In a lower part of a front face of the housing 2, an opening part 2*a* is formed. Into this opening part 2*a*, a sheet feeding cartridge 3 storing a sheet is attachably/detachably installed in forward and backward directions. At a right upper side of the sheet feeding cartridge 3, a sheet feeding device 4 feeding the sheet from the sheet feeding cartridge 3 is provided.

In the housing 2, an image forming part 5 is built above the sheet feeding device 4. In the image forming part 5, a photosensitive drum 6 is rotatably arranged. Around the photosensitive drum 6, a charging device 7, a development device 8, a transferring roller 9 and a cleaning device 10 are located along a rotating direction (a direction indicated by an arrow X in FIG. 1) of the photosensitive drum 6. The development device 8 is connected with a toner container 11. At a left side of the image forming part 5, an exposure device 12 composed of a laser scanning unit (LSU) is arranged.

Above the image forming part 5, a fixing device 13 is arranged. At a left side of the fixing device 13, a sheet ejecting part 14 is provided. The sheet ejecting part 14 faces to an ejected sheet tray 15 formed on an upper face of the housing 2.

Inside the housing 2, a sheet conveyance path 18 is arranged so as to travel from the sheet feeding device 4, to pass through a transferring nip 17 formed between the photosensitive drum 6 and the transferring roller 9 and through the fixing device 13 and to go toward the sheet ejecting part 14.

Next, image forming operation of the image forming apparatus 1 having such a configuration will be described. After a surface of the photosensitive drum 6 is electrically charged by the charging device 7, exposure corresponding to image data is carried out to the photosensitive drum 6 by a laser light (refer to an arrow P) from the exposure device 12. Thereby, an electrostatic latent image is formed on the surface of the photosensitive drum 6. The electrostatic latent image is developed to a toner image by the development device 8. The toner remained on the photosensitive drum 6 is removed by the cleaning device 10.

On the other hand, the sheet fed from the sheet feeding cartridge 3 to the conveyance path 18 by the sheet feeding device 4 is conveyed to the transferring nip 17 in a suitable timing for the above-mentioned image forming operation. Then, in the transferring part 17, the toner image on the photosensitive drum 6 is transferred onto the sheet. The sheet with the transferred toner image is conveyed to a downstream side on the conveyance path 18 to enter the fixing device 13, and then, the toner image is fixed on the sheet in the fixing device 13. The sheet with the fixed toner image is ejected from the sheet ejecting part 14 onto the ejected sheet tray 15.

Figure 2:
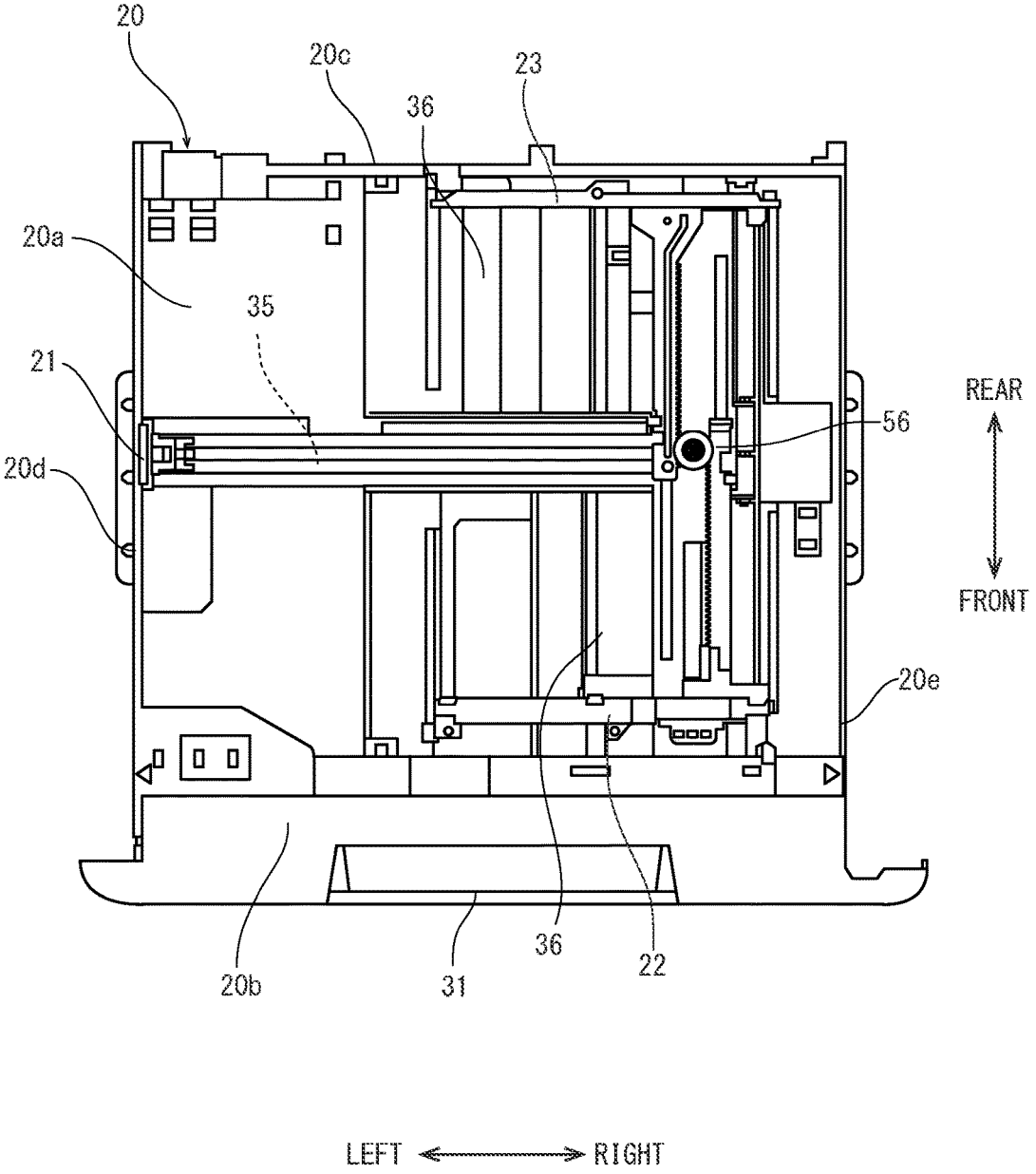
FIG. 2 is a plan view of a main body of a sheet feeding cartridge in the printer according to the embodiment of the present disclosure.
Figure 3:
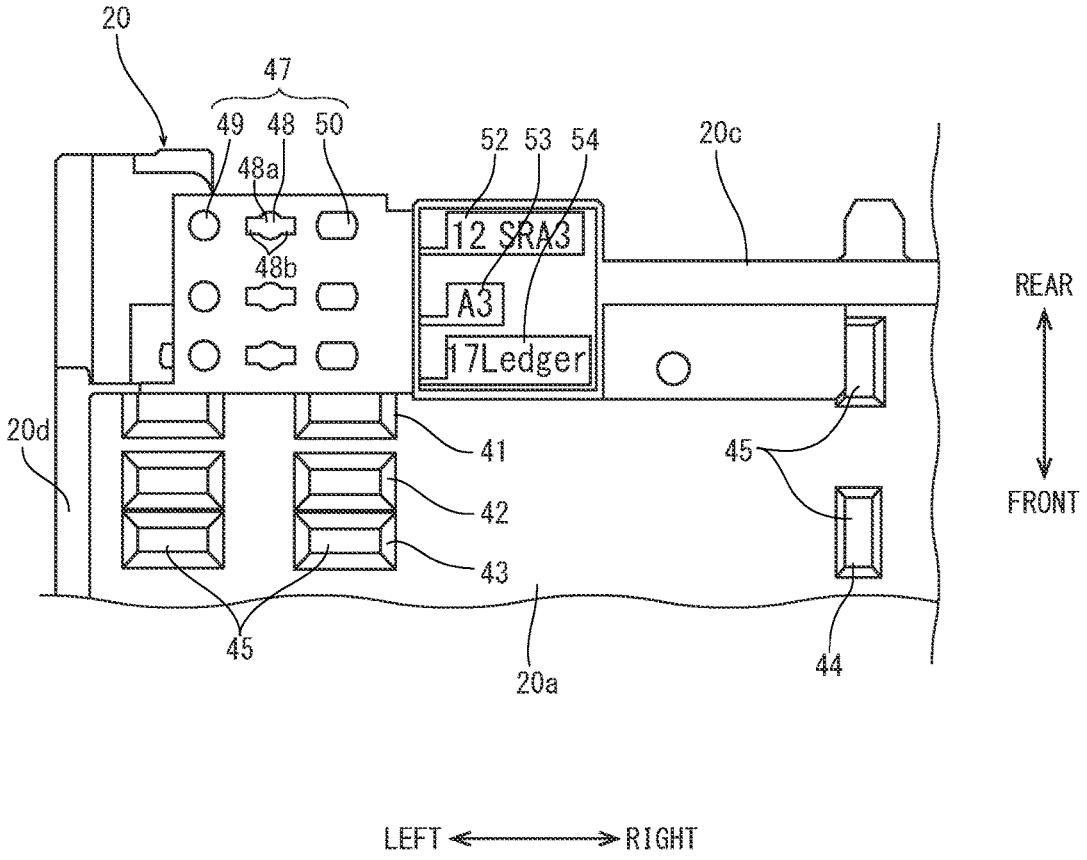
FIG. 3 is a plan view showing a rear left corner of a bottom plate of the main body in the sheet feeding cartridge of the printer according to the embodiment of the present disclosure.
Figure 4A:
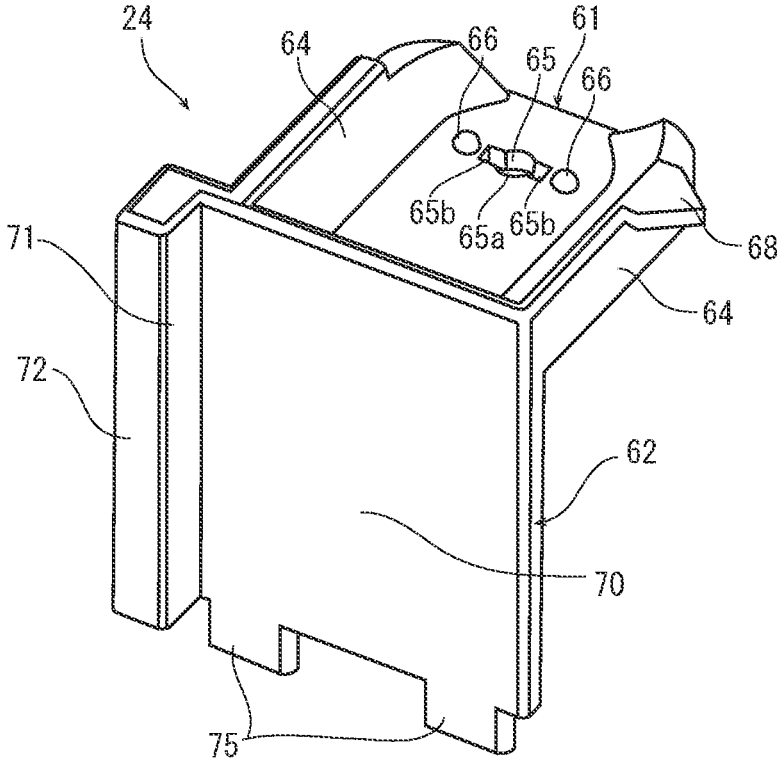
FIG. 4A is a perspective view showing a restricting member as seen from an upper side.
Figure 4B:
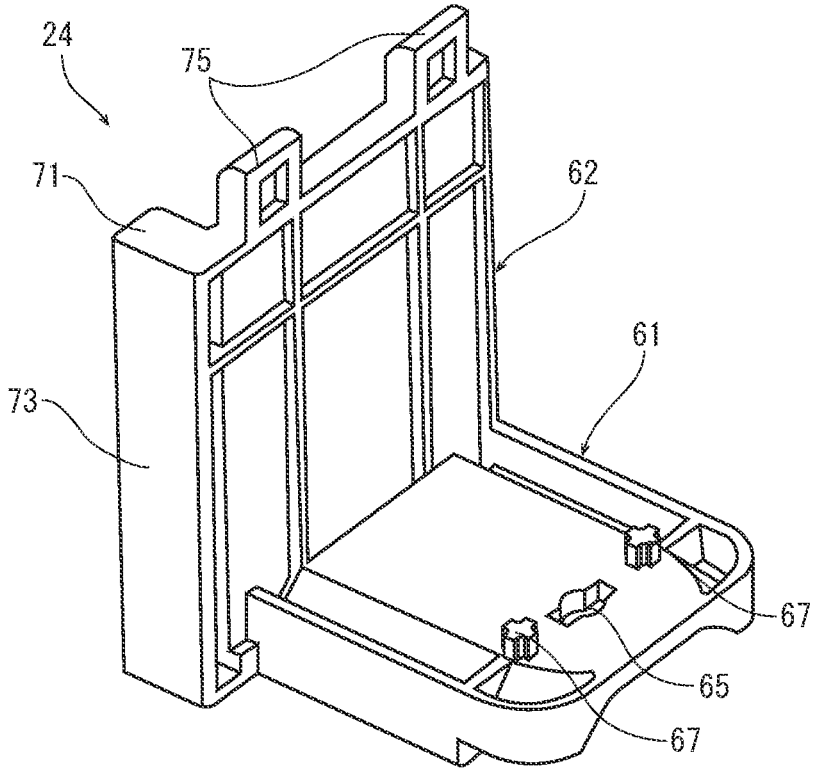
FIG. 4B is a perspective view showing the restricting member as seen from an lower side, in the sheet feeding cartridge of the printer according to the embodiment of the present disclosure.
Figure 5:
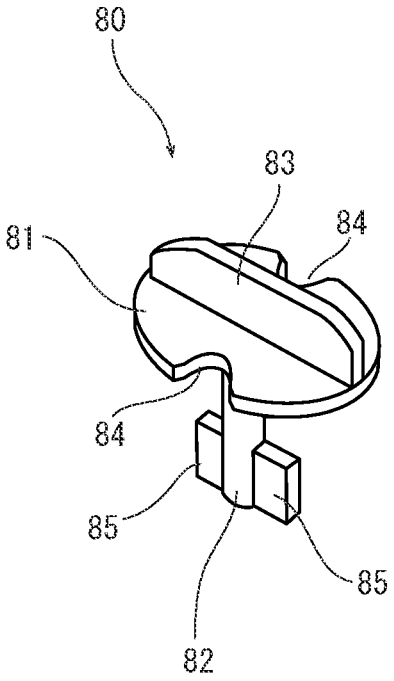
FIG. 5 is a perspective view showing a coupling member between the restricting member and the main body in the sheet feeding cartridge of the printer according to the embodiment of the present disclosure.
Figure 6:
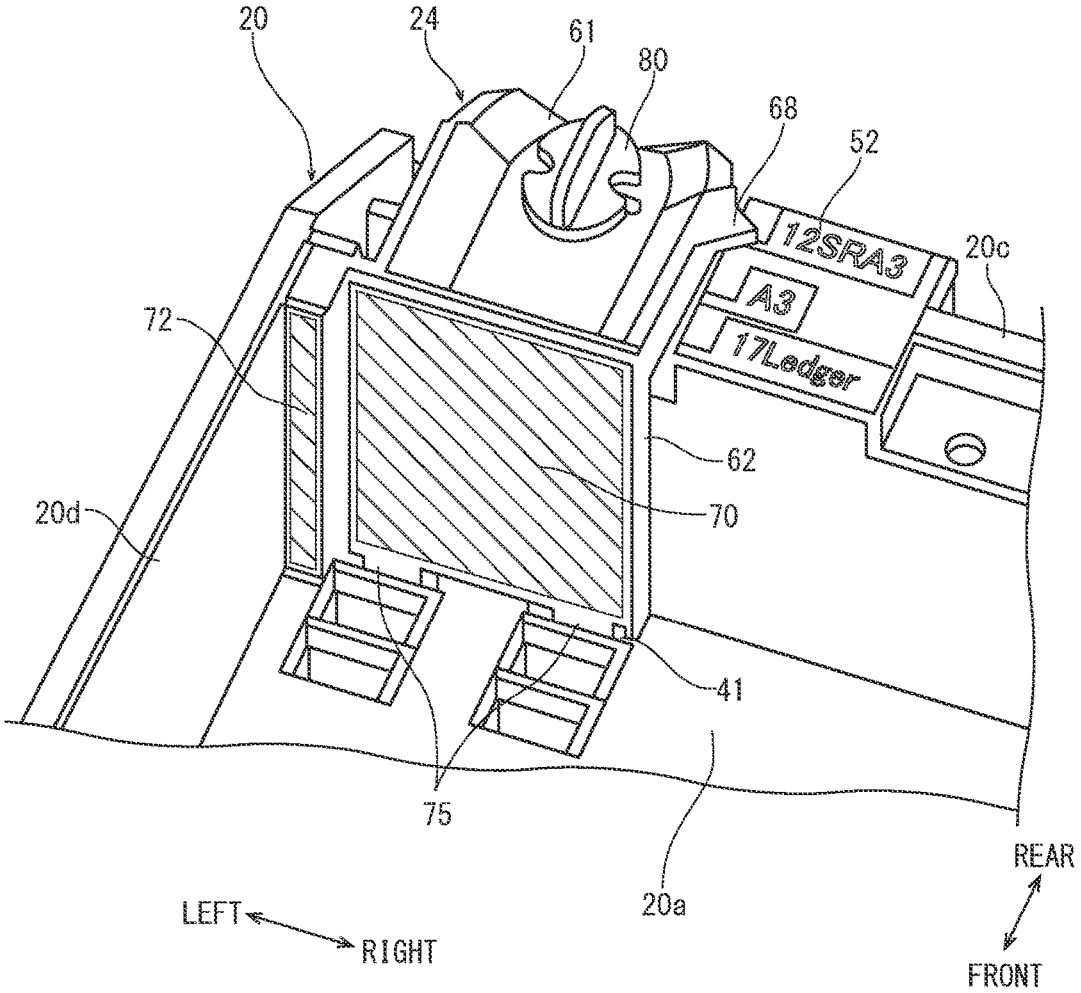
FIG. 6 is a perspective view showing the restricting member attached to the main body in the sheet feeding cartridge of the printer according to the embodiment of the present disclosure.
Figure 7:
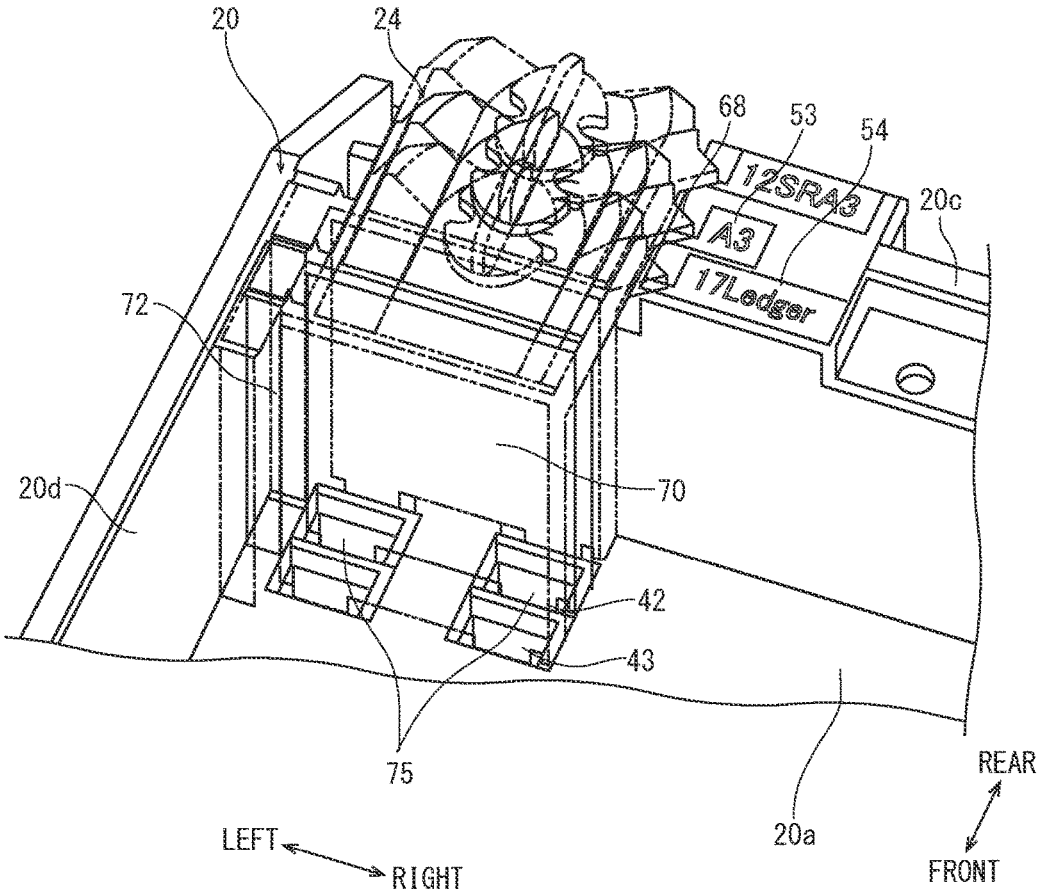
FIG. 7 is a perspective view showing the restricting member attached to the main body in the sheet feeding cartridge of the printer according to the embodiment of the present disclosure.
Figure 8:
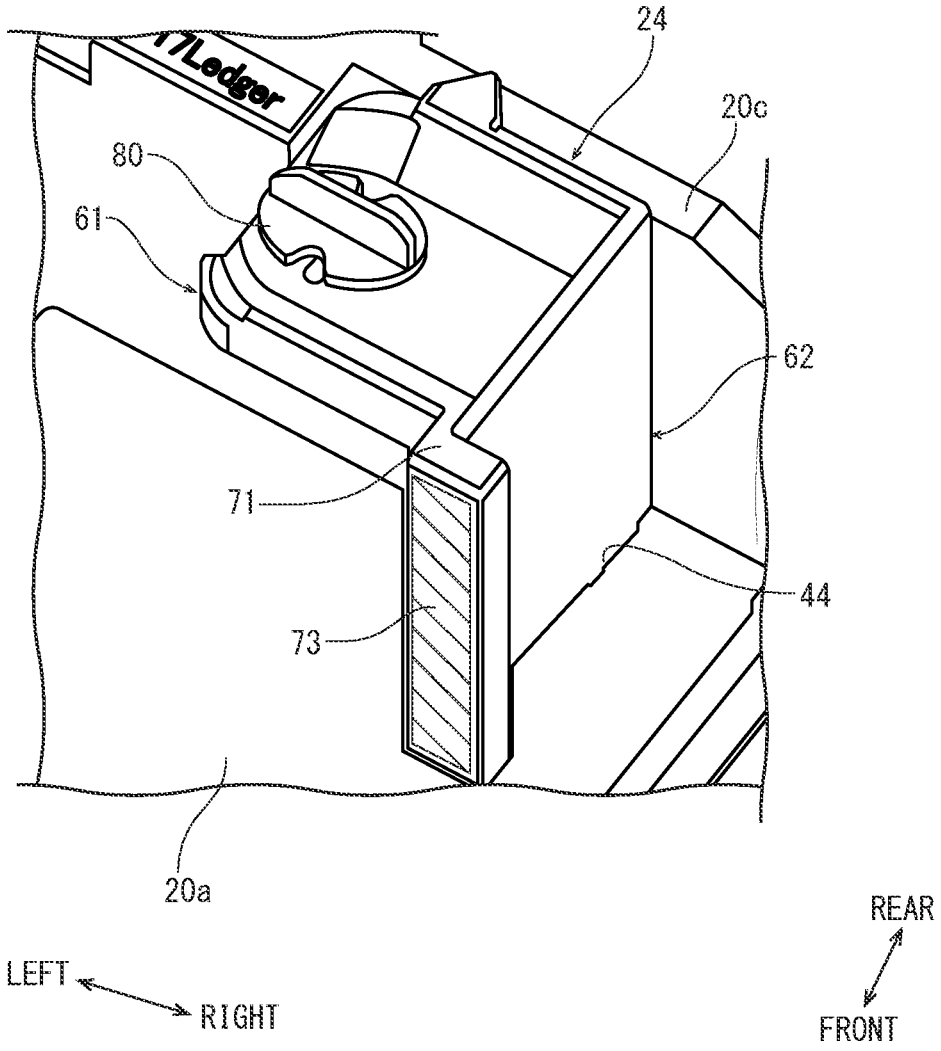
FIG. 8 is a perspective view showing the restricting member attached to the main body in the sheet feeding cartridge of the printer according to the embodiment of the present disclosure.

Next, the sheet feeding cartridge will be described with reference to FIG. 2 to FIG. 6. FIG. 2 is a plan view of a main body of the sheet feeding cartridge; FIG. 3 is a plan view showing a part of a bottom plate of the main body; FIG. 4A and FIG. 4B are perspective views showing a restricting member; FIG. 5 is a perspective view showing a coupling member; and FIG. 6 to FIG. 8 are perspective views showing the restricting member attached to the main body. In the following description, the left and right directions designate a conveyance direction of the sheet, and the forward and backward directions designate a width direction of the sheet. In the embodiment, the sheet feeding cartridge 3 stores the sheet to be conveyed in an orthogonal direction to the width direction, and the image forming part 5 forms an image on the sheet conveyed in the orthogonal direction to the width direction of the sheet from the sheet feeding cartridge 3.

The sheet feeding cartridge 3 includes, as shown in FIG. 2, the main body 20 in which a sheet is stored; an end cursor 21 slidably supported in the conveyance direction of the sheet; a pair of a front cursor 22 (a side cursor) and a rear cursor 23 (a side cursor) slidably supported in the width direction of the sheet; and a restricting member 24 attachably/detachably coupled to the main body 20 at an upstream side from the front cursor 22 and the rear cursor 23 in the conveyance direction of the sheet. The sheet feeding cartridge 3 further includes an elevating plate (not shown) on which the sheet is placed. The elevating plate is supported by an elevating mechanism (not shown) so as to incline upwardly with a left end as a fulcrum to make a tip end of the sheet approached a sheet feeding device 4.

The main body 20 has a shallow box-like shape of which an upper face is opened, and has a bottom plate 20*a* (a bottom part); front and rear side walls 20*b* and 20*c*; and left and right side walls 20*d* and 20*e*. On the front side wall 20*b*, a grip 31 for pulling out the sheet feeding cartridge is provided. Incidentally, the rear side wall 20*c* (a wall part) is provided at an end in the width direction at the upstream side in the conveyance direction in the main body 20.

In the bottom plate 20*a*, as shown in FIG. 2, a shallow center gap 35 extending in the left and right directions is formed at a center in the forward and backward directions. Moreover, in the bottom plate 20*a*, guiding depressions 36 extending in the forward and backward directions are respectively formed at both front and rear sides positioned across the center gap 35.

In the bottom plate 20*a* (the bottom part), a plurality of positioning parts respectively corresponding to a first position, a second position, and a third position described later are provided at intervals along the width direction. For example, as shown in FIG. 3, at a left rear corner of the bottom plate 20*a*, first to fourth positioning parts 41, 42, 43, 44 for positioning a restricting member 24 are formed. Each positioning part is configured so that two rectangular apertures 45 are formed at predetermined intervals in a lengthwise direction of the aperture 45. The first to third positioning parts 41, 42, 43 are disposed so that the respective apertures 45 are located along the left and right directions, and are formed at predetermined intervals in the forward and backward directions at the left rear corner of the bottom plate 20*a* in sequential order from a side of the rear side wall 20*c*. The first positioning part 41 at the rearmost side is formed along the rear side wall 20*c*. In addition, the fourth positioning part 44 is disposed so that the respective apertures 45 are located along the forward and backward directions, and is formed at a right side from the left rear corner of the bottom plate 20*a*.

At a left end part on an upper face of the rear side wall 20*c*, coupling parts 47 for coupling to the restricting member 24 are formed in three sites at predetermined intervals in parallel to the forward and backward directions so as to correspond to the first to third positioning parts 41, 42, 43. The coupling part 47 has: a fixing hole 48 provided at a center; and a left coupling hole 49 and a right coupling hole 50 respectively provided in both left and right sides of the fixing hole 48. In other words, the fixing hole 48 is disposed between a pair of the left coupling hole 49 and the right coupling hole 50. In addition, on the upper face of the rear side wall 20*c* (the wall part), a plurality of coupling holes, such as the left coupling hole 49 and the right coupling hole 50, are disposed at intervals along the width direction so as to respectively correspond to the first position, the second position, and the third position described later. For example, on the upper face of the rear side wall 20*c* (the wall part), a plurality of the pairs of the coupling hole 49 and the right coupling hole 50 arranged at the predetermined interval in the conveyance direction are disposed at the predetermined intervals in the width direction. The fixing hole 48 has: a center part 48*a* formed in a circular shape in a planar view; and side end parts 48*b* extending in a radial direction from both left and right sides of the center part 48*a*. The left coupling hole 49 is formed in a circular shape in a planar view, and the right coupling hole 50 is an elongated hole elongated in the left and right directions in a planar view.

At a right side of each coupling part 47, in sequential order from a rear side, indication parts 52, 53, 54 respectively indicating various attachment positions of the restricting member 24 according to the sheet sizes are provided. The indication part 52 indicates the attachment position of the restricting member 24 with respect to: the sheet of a predetermined first size, e.g., a 12SRA3 size (450 mm×320 mm); and the sheet of a second size being different in width from the first size (specifically, the second size having a smaller width and a larger length than those of the first size), e.g., a size of 12 inch×18 inch (304.8 mm×431.8 mm). The indication part 53 indicates the attachment position of the restricting member 24 with respect to the sheet of a third size being different in width from the first size and the second size, e.g., A3 size (297 mm×420 mm). The indication part 54 indicates the attachment position of the restricting member 24 with respect to the sheet of a fourth size being different in width from the first size, the second size and the third size, e.g., a 17Ledger size (11 inch×7 inch (about 279 mm×432 mm)).

Referring to FIG. 2 again, the end cursor 21 is slidably supported in an erected posture with respect to the bottom plate 20*a* along a center gap 35 formed in the bottom plate 20*a* of the main body 20. Moreover, the front cursor 22 and the rear cursor 23 are provided, on the bottom plate 20*a* of the main body 20, over a length of approximately half of the upstream side in the conveyance direction. The front cursor 22 and the rear cursor 23 are respectively engaged with the guiding depressions 36 of the bottom plate 20*a*, and are slid in approaching and separating directions with reference to the center in the width direction of the sheet by a rack/pinion mechanism 56.

Next, the restricting member 24 will be described with reference to FIG. 4A and FIG. 4B. FIG. 4A is a perspective view showing the restricting member as seen from an upper side; and FIG. 4B is a perspective view showing the restricting member as seen from a lower side. The restricting member 24 has an L-shape having a coupling part 61 and a restricting part 62 orthogonally connected to each other.

The coupling part 61 is formed in a rectangular shape in a planar view; is provided to be parallel to a sheet placement face included in the bottom plate 20*a* (the bottom part) of the main body 20; and is configured so as to couple the restricting member 24 and the main body 20 to each other. Protrusive ribs 64 are respectively formed along both side edges on an upper face of the coupling part 61. Each rib 64 is formed so that an inner face is inclined toward an upper face, and the upper face is narrower as it goes to a tip end. At a tip end part of the coupling part 61, a through hole 65 is formed so as to be disposed between a pair of projected parts 67 and to penetrate the coupling part 61 in the upward and downward directions. The through hole 65 has: a center part 65*a* formed in a circular shape in a planar view; and side end parts 65*b* extending in the radial direction from both sides of the center part 65*a* in a direction along a tip end edge of the coupling part 61. In addition, in the upper face of the coupling part 61, on both sides of the through hole 65 in the direction along the tip end edge of the coupling part 61, a pair of short projections 66 formed in roughly hemispheric shapes are respectively formed. In a lower face of the coupling part 61, on both sides of the through hole 65 in the direction along the tip end edge of the coupling part 61, a pair of projected parts 67 are respectively projected, each of which has a roughly cross-shape in a sectional view.

In addition, on an outer face of one side of the protrusive rib 64 formed on the upper face of the coupling part 61 (the rib formed at the downstream side in the conveyance direction in the posture in which the restricting member 24 is positioned so that the restricting part 62 faces to a side edge of the sheet), an indicative protrusion 68 formed in a triangular shape in a planar view is protruded.

The restricting member 62 is formed in a rectangular shape in a planar view; is provided to be perpendicular to the sheet placement face included in the bottom plate 20*a* (the bottom part) of the main body 20; and is configured so as to come into contact with a side edge in the width direction of the sheet. An outside face of the restricting member 62 composes a flat first restricting face 70. On the first restricting face 70, a rectangular parallelepiped protruded part 71 protruded forwardly along one side edge (the side edge at the upstream side in the conveyance direction in the posture in which the restricting member 24 is positioned so that the restricting part 62 faces to the side edge of the sheet) is formed. A front face of the protruded part 71 composes a flat second restricting face 72 being parallel to the first restricting face 70. Further, in the protruded part 71, on an opposite side to the first restricting face 70, a flat third restricting face 73 orthogonally connected to the second restricting face 72 is formed. On a lower face of the restricting part 62, a pair of positioning projections 75 projected downwardly from a lower end are formed.

The restricting member 24 is configured so as to be attached and detached with respect to the main body 20, and fixed to the main body 20 by a fixing member 80. The fixing member 80 includes, as shown in FIG. 5, a flat plate-like main body part 81 formed in a roughly elliptical shape in a planar view and a shaft part 82 extending from a lower face of the main body part 81. On an upper face of the main body part 81, a grip part 83 extending in a longitudinal direction is formed. In addition, at centers of both side edges in the longitudinal direction of the main body part 81, recessed parts 84 recessed to the inside are respectively formed. At a lower end part of the shaft part 82, a locking part extending in an opposite direction along the longitudinal direction is formed. The fixing member 80 is inserted into the fixing hole 48 of the rear side wall 20*c* (the wall part) through the through hole 65 of the coupling part 61, and then, the coupling part 61 is fixed to the rear side wall 20*a*.

Figure 9:
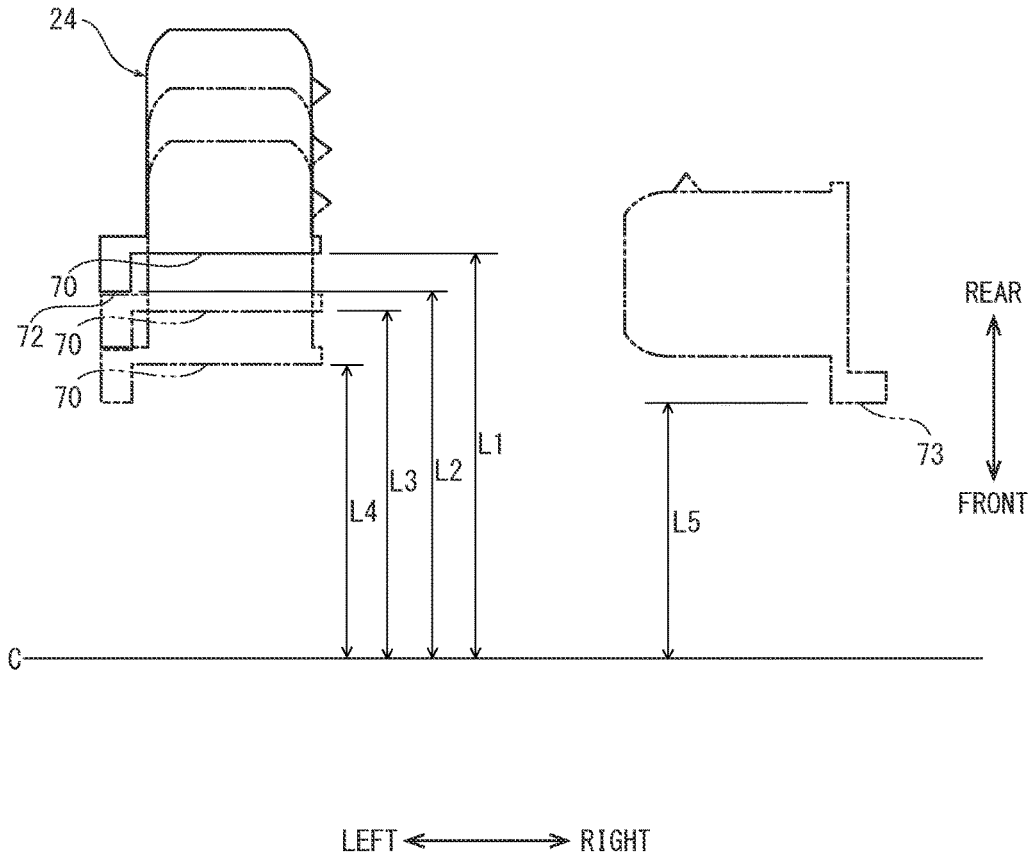
FIG. 9 is a plan view showing the restricting member restricting sheets of various sizes in the sheet feeding cartridge of the printer according to the embodiment of the present disclosure.

The restricting member 24 having the configuration as mentioned above is formed so that, when being attached to the main body 20, as shown in FIG. 9, each of the first restricting face 70, the second restricting face 72 and the third restricting face 73 comes into contact with a side edge of each of the sheets of different sizes.

First, in a case where the sheet of the SRA3 size is stored, as shown in FIG. 6, the restricting member 24 is positioned so that the restricting part 62 faces to a side edge of the sheet, and the coupling part 61 is coupled with the main body 20 at the position (the first position) where the indicative protrusion 68 of the coupling part 61 indicates the indication part 52 provided on the upper face of the rear side wall 20*c* of the main body 20. In this manner, the second restricting face 72 is disposed at the upstream side in the conveyance direction and at the inside in the width direction with respect to the first restricting face 70. Specifically, the respective projected parts 67 formed on the lower face of the coupling part 61 are inserted into the left and right coupling holes 49 and 50 of the coupling part 47 formed on the upper face of the rear side wall 20*c*, and the positioning projections 75 formed on the lower face of the restricting part 62 are inserted into the first positioning part 41 formed on the bottom plate 20*a*. In this manner, a rear side face of the restricting part 62 comes into contact with the rear side wall 20*c* of the main body 20 and the third restricting face 73 of the restricting member 24 comes into contact with the left side wall 20*d* of the main body 20.

Afterwards, the coupling part 61 is fixed to the rear side wall 20*c* by the fixing member 80. At this time, while the grip 83 of the fixing member 80 is gripped, the respective locking parts 85 are aligned to the side end parts 48*b* of the fixing hole 48 and the shaft part 82 is routed into the center 48*a* of the fixing hole 48, and thereafter, the fixing member 80 is turned around the shaft part 82. In this manner, the coupling part 61 of the restricting member 24 is locked with the rear side wall 20*c* by the locking part 85. In addition, the recessed parts 84 of the main body part 81 of the fixing member 80 are engaged with the respective projections 66.

In a state that the restricting member 24 is thus coupled to the main body 20, as shown in FIG. 9, a distance L1 along the width direction of the sheet from a center position C in the width direction of the sheet defined by the front cursor 22 and the rear cursor 23 to the first restricting face 70 of the restricting member 24 is set so as to be ½ (160 mm) of the sheet of the SRA3 size.

Further, as shown in FIG. 9, a distance L2 along the width direction of the sheet from the center position C in the width direction of the sheet to the second restricting face 72 of the restricting member 24 is set so as to be ½ (152 mm) of the width of the sheet of the size of 12 inch×18 inch. Incidentally, because the sheet of the size of 12 inch×18 inch is larger in length in the conveyance direction than the sheet of the SRA3 size, the second restricting face 72 is formed at the upstream side in the conveyance direction from the first restricting face 70.

Furthermore, as shown in FIG. 7, coupling to the main body 20 by the fixing member 80 is released, and then, the coupling part 61 is coupled to the main body 20 at the position where the indicative protrusion 68 of the coupling part 61 indicates the indication part 53 provided on the upper face of the rear side wall 20*c* of the main body 20 (the second position being different from the first position in the width direction of the sheet). In a state that the restricting member 24 is thus attached to the main body 20, a distance L3 along the width direction of the sheet from the center position C of in the width direction of the sheet to the first restricting face 70 of the restricting member 24 is set so as to be ½ (148.5 mm) of the width of the sheet of the A3 size.

Similarly, the coupling part 61 is coupled to the main body 20 at the position where the indicative protrusion 68 of the coupling part 61 indicates the indication part 54 provided on the upper face of the rear side wall 20*c* of the main body 20 (the third position being different from the first position and the second position in the width direction of the sheet). In the state that the restricting member 24 is attached to the main body 20, as shown in FIG. 9, a distance L4 along the width direction of the sheet from the center position C in the width direction of the sheet to the first restricting face 70 of the restricting member 24 is set so as to be ½ (139.5 mm) of the width of the sheet of Ledger.

In addition, as shown in FIG. 8, the restricting member 24 (the restricting part 62) is turned so that the third restricting face 73 is disposed to be parallel to the conveyance direction, the restricting member 24 is positioned so that the third restricting face 73 faces to the side edge of the sheet, and then, the positioning projections 75 formed on the lower face of the coupling part 61 are inserted into the fourth positioning part 44; and the coupling 61 is coupled to the main body 20 at the fourth position being different from the first position, the second position and the third position in the width direction of the sheet. In such a state, as shown in FIG. 9, a distance L5 along the width direction of the sheet from the center position C in the width direction of the sheet to the third restricting face 73 is set so as to be equal to a fifth size being different in length from the first size, the second size, the third size and the fourth size, e.g., so as to be ½ (128 mm) of the width of the sheet of the B4 size. Because the sheet of the B4 size is smaller in length than the sheet of the SRA3 size, the A3 size or the size of 12 inch×18 inch, the restricting member 24 is configured so as to be coupled to the main body 20 at the downstream side in the conveyance direction. In addition, the shaft part 82 of the fixing member 80 is inserted into the fixing hole 48 of the coupling part 47, and the shaft part 82 comes into contact with the front face of the rear side wall 20*c* of the main body 20.

A method of restricting a position in the width direction of a sheet by using this restricting member 24 will be described. For example, in order to feed the sheet of the SRA3 size, the restricting member 24 is positioned so that indicative protrusion 68 of indicates the indication part 52 and is coupled to the main body 20 by the fixing member 80. Afterwards, the sheet is set on the placement plate, and the position in the width direction is restricted by the front cursor 22 and the rear cursor 23. In this manner, with respect to the side edge of the rear side of the sheet, the end part at the upstream side in the conveyance direction is restricted by the first restricting face 70 of the restricting member 24, and a portion of approximately half at the downstream side in the conveyance direction is restricted by the rear cursor 23. After the sheet has been thus stored, even if the sheet feeding cartridge 3 is attached with a comparatively strong force, the end part at the upstream side in the conveyance direction of the sheet not restricted by the rear cursor 23 is restricted by the first restricting face 70, and accordingly, skew of the sheet does not occur.

As described above, in the sheet feeding cartridge of the present disclosure, since the number of restriction positions of the sheets in the width direction can be increased, it is possible to restrict the positions in the width direction of sheets of more sizes and to store the sheets without any skew. Moreover, in the sheet feeding cartridge 3, by using the restricting member 24, as shown in FIG. 9, it is possible to restrict the position in the width direction at the end part at the downstream side in the conveyance direction of each of the sheets of the SRA3 size (450 mm×320 mm), the size of 12 inch×18 inch, the A3 size, and the Ledger size (11 inch×17 inch) and the B4 size and to feed the sheets without any skew. In addition, in the restricting member 24, since the coupling part 61 is coupled to the rear side wall 20*c* of the main body 20, and the positioning projections 75 formed on the lower face of the restricting part 62 is inserted into each of the positioning parts of the bottom plate 20*a* of the main body 20, even if a strong force is applied to each restricting face from the sheet at the time of attaching the sheet feeding cartridge 3, the coupling is neither released nor moved, and therefore, it is possible to stably feed the sheets always. In this manner, by using the restricting member 24 with its simple configuration, it is possible to restrain the skew of the sheets of the various sizes and to prevent occurrence of a sheet feeding failure or an image failure.

Further, the restricting member 24 can be attachably/detachably coupled to the main body 20 at a plurality of positions along the width direction and the conveyance direction and the restricting member 24 per se has a plurality of restricting faces, and therefore, by one restricting member 24, it is possible to cope with a plurality of the sheets with different sizes and to restrict a side edge of each of the sheets of the different sizes in the width direction and the conveyance direction. For example, the restricting member 24 may be provided to be attachable to or detachable from the main body 20 at the plurality of positions along the lengthwise direction of the sheet (the conveyance direction). In this manner, it is possible to restrict the positions in the width direction of the sheets of the different lengths, and therefore, to restrict the position in the width direction of each of the sheets of various sizes. Moreover, the restricting member 24 may have at least two restricting faces disposed to be parallel to each other or at least two restricting faces disposed to be orthogonal to each other, or alternatively, both of them. In this manner, it is possible to increase the number of restriction positions, and therefore, to restrict the positions in the width direction of the sheets of more various sizes.

In addition, since the restricting member 24 is configured by compact specification and is easily attachable or detachable, inconvenience in which the sheet feeding cartridge 3 is enlarged or the mechanism is complicated is not caused. Further, the restricting member 24 can be coupled to the main body 20 while the posture of the restricting member 24 is varied so as to adjust to the shape of the main body 20. Incidentally, as long as the restricting member 24 is always attached to the sheet feeding cartridge 3 by the fixing member 80, it is unnecessary to keep the restricting member 24 separately from the sheet feeding cartridge 3, and therefore, there is no possibility of eliminating the restricting member 24 and it is unnecessary to newly prepare another keeping location.

Furthermore, in accordance with the configuration of the restricting member 24, as mentioned above, when the coupling part 61 is coupled to the main body 20 at the first position, the position in the width direction of the sheet of the first size is restricted by the first restricting face 70 and the position in the width direction of the sheet of the second size is restricted by the second restricting face 72. Moreover, when the coupling part 61 is coupled to the main body 20 at the second position, the position in the width direction of the sheet of the third size is restricted by the first restricting face 70. Further, when the coupling part 61 is coupled to the main body 20 at the third position, the position in the width direction of the sheet of the fourth side is restricted by the first restricting face 70. In this manner, by one restricting member 24, it is possible to restrict the sheets of four kinds of different widths in the width direction.

Still furthermore, the restricting member 24 is configured, as mentioned above, so that when the coupling part 61 is coupled to the main body 20 at the fourth position, the position in the width direction of the sheet of the fifth size is restricted by the third restricting face 73. In this manner, it is also possible to restrict the width directions of the sheets with different lengths.

In addition, the sheet feeding cartridge 3 is attachably/detachably supported in the width direction of the sheet, and the restricting member 24 is provided to be attachable to or detachable from the main body 20 at the upstream side in the conveyance direction of the sheet from the pair of side cursors 22 and 23. In this manner, when the sheet feeding cartridge 3 is attached, it is possible to reliably prevent the skew of the end part at the upstream side in the conveyance direction of the sheet.

Although the embodiment was described about the configuration in which the restricting member 24 is attached to or detached from the rear left corner of the sheet feeding cartridge 3, another attachable/detachable restricting member 24 may be provided at a front left corner of the sheet feeding cartridge 3.

The embodiment of the present disclosure was described in a case of applying the configuration of the disclosure to the printer 1. On the other hand, in another embodiment, the configuration of the disclosure may be applied to another image forming apparatus, such as a copying machine, a facsimile, a multifunction peripheral or the like, except for the printer 1.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

What is claimed is:

1. A sheet feeding cartridge configured to store a sheet to be conveyed in a direction orthogonal to a width direction, comprising:

a main body having a bottom part including a sheet placement face and allowing sheets of different sizes to be placed;

a pair of side cursors configured to mutually slide in approaching and separating directions, and then, to restrict a position in the width direction of the sheets; and a restricting member configured to come into contact with a side edge in the width direction of the sheets at a position separated from one of the pair of side cursors to an upstream side in a conveyance direction, and then, to restrict the position in the width direction, wherein the restricting member is attachably/detachably provided in the main body at each of a plurality of positions along the width direction and is capable of restricting the side edge of each of the sheets of different sizes in the width direction, the restricting member includes:

a restricting part provided to be perpendicular to the sheet placement face of the main body and coming into contact with the side edge in the width direction; and a coupling part provided to be parallel to the sheet placement face and coupling the restricting part and the main body, the restricting part has a first restricting face and a second restricting face being parallel to the first restricting face, when the coupling part is coupled to the main body at a first position, the second restricting face is disposed at an upstream side in the conveyance direction and at the inside in the width direction with respect to the first restricting face, and then, a position in the width direction of the sheet of a first size is restricted by the first restricting face and a position in the width direction of the sheet of a second size having a smaller width and a larger length than the first size is restricted by the second restricting face, further, when the coupling part is coupled to the main body at a second position being different from the first position in the width direction, a position in the width direction of the sheet of a third size being different in width than the first size and the second size is restricted by the first restricting face, and when the coupling part is coupled with the main body at a third position being different from the first position and the second position in the width direction, a position in the width direction of the sheet of a fourth size being different in width from the first size, the second size and the third size is restricted by the first restricting face.

2. The sheet feeding cartridge according to claim 1, wherein the restricting member is attachably/detachably provided in the main body at each of a plurality of positions along the conveyance direction and is capable of restricting the side edge of each of the sheets of different sizes in the conveyance direction.

3. The sheet feeding cartridge according to claim 1, wherein the restricting member has at least two restricting faces disposed to be parallel to each other or at least two restricting faces disposed to be orthogonal to each other.

4. The sheet feeding cartridge according to claim 1, wherein the restricting part further has a third restricting face orthogonally connected to the second restricting face, and when the restricting part is turned so that the third restricting face is disposed to be parallel to the conveyance direction and the coupling part is coupled to the main body at a fourth position being different from the first position, the second position and the third position in a lengthwise direction of the sheets, a position in the width direction of the sheet of a fifth size being different from the first size, the second size, the third size and the fourth size is restricted by the third restricting face.

5. The sheet feeding cartridge according to claim 1, wherein the main body includes a wall part provided at an end part in the width direction at the upstream side in the conveyance direction, in an upper face of the wall part, a plurality of coupling holes disposed at intervals along the width direction and respectively corresponding to the first position, the second position and the third position are provided, on the bottom part, a plurality of positioning parts respectively corresponding to the first position, the second position and the third position are provided at intervals along the width direction, the coupling part has a projected part projected on a lower face, the restricting part has a positioning projection projected from a lower end, when the projection is inserted into each of the coupling holes and the positioning projection is inserted into each of the positioning parts, the restricting member is coupled with the main body.

6. The sheet feeding cartridge according to claim 5 further comprising:

a fixing member, wherein the coupling part has a pair of the projected parts and a through hole disposed between the pair of the projected parts and penetrating the coupling part in upward and downward directions, in the upper face of the wall part, a plurality of pairs of the coupling holes arranged at a predetermined interval in the conveyance direction are disposed at predetermined intervals in the width direction, the wall part has a fixing hole disposed between each pair of the coupling holes, the fixing member is inserted into the fixing hole of the wall part from the through hole of the coupling part to fix the coupling part to the wall part.

7. An image forming apparatus comprising:

the sheet feeding cartridge according to claim 1;

an image forming part configured to form an image on the sheet conveyed in an orthogonal direction to the width direction of the sheet from the sheet feeding cartridge; and a housing in which the sheet feeding cartridge is attachably/detachably installed and in which the image forming part is built.

* * * * *